United States Patent [19]

Watanabe

[11] Patent Number: 4,487,685

[45] Date of Patent: Dec. 11, 1984

[54] METHOD FOR PRODUCING MESOPHASE-CONTAINING PITCH BY USING CARRIER GAS

[75] Inventor: Masami Watanabe, Tokyo, Japan

[73] Assignee: Kashima Oil Company Limited, Chiyodaku, Japan

[21] Appl. No.: 507,585

[22] Filed: Jun. 24, 1983

[51] Int. Cl.[3] ..... C10C 1/00

[52] U.S. Cl. ..... 208/44; 208/40; 208/39; 208/22

[58] Field of Search ..... 208/44, 40, 39, 22

[56] References Cited

U.S. PATENT DOCUMENTS

| | | | |
|---|---|---|---|
| 3,928,170 | 12/1975 | Takahashi | 208/40 |
| 3,974,264 | 8/1976 | McHenry | 423/447.4 |
| 3,976,729 | 8/1976 | Lewis et al. | 423/447.6 |
| 3,995,014 | 10/1976 | Lewis | 423/447.4 |
| 4,005,183 | 1/1977 | Singer | 208/44 |
| 4,026,788 | 5/1977 | McHenry | 208/40 |
| 4,032,430 | 6/1977 | Lewis | 423/447.1 |
| 4,209,500 | 6/1980 | Chwastiak | 208/44 |
| 4,303,631 | 12/1981 | Lewis et al. | 423/447.1 |
| 4,317,809 | 3/1982 | Lewis et al. | 208/39 |

FOREIGN PATENT DOCUMENTS

| | | | |
|---|---|---|---|
| 44714 | 1/1981 | European Pat. Off. | 208/44 |
| 27739 | 4/1981 | European Pat. Off. | 208/44 |
| 55-102690 | 8/1980 | Japan | 208/40 |
| 57-473853 | 3/1982 | Japan | 423/447.2 |
| 2099845 | 12/1982 | United Kingdom | 208/22 |

*Primary Examiner*—Carl F. Dees
*Assistant Examiner*—Helane E. Maull
*Attorney, Agent, or Firm*—Armstrong, Nikaido, Marmelstein & Kubovcik

[57] ABSTRACT

A method for producing a mesophase-containing pitch from petroleum pitch or coal tar pitch is disclosed. According to this method volatile distillate fractions, which are harmful to mesophase formation and present originally in the raw material pitch or formed as by-product during heat treatment time are driven off by using a carrier gas at a temperature of 360° to 450° C. in order to shorten the overall heat treatment time and advance the mesophase formation smoothly by the increase of stirring effect.

4 Claims, No Drawings

METHOD FOR PRODUCING MESOPHASE-CONTAINING PITCH BY USING CARRIER GAS

BACKGROUND OF THE INVENTION

This invention relates to a method for producing a mesophase-containing pitch, as a raw material for high-strength, high modulus carbon fibers. More particularly, it relates to a method for producing a mesophase-containing pitch, which enables us to produce, at a low price, within a short time, high strength, high modulus carbon fibers which are preferable raw materials for composite articles.

DESCRIPTION OF PRIOR ART

As the result of recent rapid growth of industries for manufacturing aircrafts, motor vehicles and other transport a demand for materials capable of exhibiting remarkable properties because of the superiority of some of their physical properties is increasing. Particularly, a demand for the advent of inexpensive materials provided with high strength and high modulus together with lightness of weight is great. However, since the material which satisfies the above-mentioned demand cannot be supplied in a large amount and in a stabilized manner according to the present status of art, research works relative to composite articles (reinforced resins) which meet the above-mentioned requirement are prevailing.

As one of the most promising materials to be used as reinforced resins, there can be mentioned high strength, high modulus carbon fibers. These materials have appeared from about the time when the rapid growth of the above-mentioned industry just started. When the carbon fibers are combined with a resin, it is possible to produce reinforced resins capable of exhibiting characteristic feature unparalleled in the past. To be regretful enough, in spite of the high strength and high-modulus of the carbon fibers for the above-mentioned reinforced resins capable of exhibiting extremely notable characteristic feature, the application fields of these fibers have not expanded. The cause of this fact, as explained later, lies in the high production cost.

It is well known that the raw materials for high strength high modulus carbon fibers which are commercially available are mostly polyacrylonitrile fibers produced by a special production process and a special spinning process but these acrylonitrile fibers are not only expensive as a raw material but also the production yield thereof from these raw materials is as low as less than 45%. These facts complicate the treatment steps for producing superior carbon fibers, resulting in the increasing production cost of the ultimate products of carbon fibers.

As for the method for producing high strength, high modulus carbon fibers at a low price, U.S. Pat. No. 4,005,183 discloses a method in which they are produced from a pitch containing from 40% to 90% mesophase. (easily observable by a polarization microscope) Thus the superiority of mesophase as a raw material for producing high strength high modulus carbon fibers has been known. As described in the official gazette of laid open Japanese patent application No. 86717 of 1978 (Tokukai No. 53-86717), the production of a mesophase containing pitch by using nitrogen, argon, xenon, helium steam, etc. as an inert gas, has been known. However, every one of these known methods for producing high strength, high modulus carbon fibers requires high cost and long time in the production.

It is an object of the present invention to provide a method for producing a mesophase containing pitch at a low price within a short time.

The above-mentioned object can be attained according to the method of the present invention.

SUMMARY OF THE INVENTION

The present invention resides in a method which comprise driving off volatile heavy distillate fractions or-pitches which are harmful to mesophase formation from the mesophase forming reaction system, while subjecting a raw material pitch to heat treatment at a temperature from 360° C. to 450° C. with stirring for from 30 minutes to 20 hours under atmospheric or sub-atmospheric pressure in order to shorten the overall heat treatment time and to smooth the mesophase formation reaction, by using, as a carrier gas, a hydrocarbon of small carbon number a naphtha fraction having a lower boiling point or a gas formed during the said heat treatment to produce heat-formed pitch containing from 20% to 60% mesophase; said volatile heavy distillate fractions or pitch being included originally in the raw material pitch as well as being formed as by-product during the time of the heat treatment and said raw material pitch being residuum carbonaceous material of petroleum-origin produced as a by-product in a catalytic cracking process (FCC) of vacuum gas oil or a thermal cracking process of naphtha or coal tar or a mixture of the above-mentioned materials.

DETAILED DESCRIPTION OF THE INVENTION

In order to produce a heat-formed pitch containing preferable amount of mesophase by the heat-treatment of petroleum-origin or tar-origin pitch at a temperature of 380° C. to 440° C., usually a time of 2 hours to 60 hours is necessary. When a temperature as high as possible within an allowable range as a heat-treatment temperature i.e. 420° C. to 440° C. is used and treatment time is shorten to 2 to 20 hours, resulting mesophase exhibits a large molecular weight which leads to worse spinning property. Accordingly, a preferable heating temperature for producing a pitch containing mesophase of good spinning property is in the range of 390° C. to 410° C. Under this temperature condition, 6 to 40 hours is necessary for heating time. If volatile fractions which are harmful to the mesophase formation and are either present originally in the form of mixture or produced as a by-product, are removed selectively and efficiently from the mesophase forming reaction system by using 2 to 10 l of a hydrocarbon gas of a small carbon number or the like per kg of pitch per minute, under this temperature condition, it is possible to greatly shorten overall heating time to about 2 to 6 hours and advance the reaction smoothly at the same time. The material obtained by removing volatile fractions will be herein referred to as precursor. The precursor is further subjected to heat treatment generally at a temperature the same or higher than that in the precursor forming step.

Further as for a hydrocarbon gas of a small number of carbon atom there are those capable of exhibiting the performance as a carrier gas under the above-mentioned heat-treatment condition, i.e. a hydrocarbon of a small carbon number, such as methane, ethane, propane, butane, etc. and naphtha fractions, etc. having lower boiling points which are not converted into heavier materials but as economically most superior gas, the dry gas (which is mostly a mixture of small carbon number) formed as by-product by subjecting a raw material to heat treatment can be mentioned.

It is to be noted that the above-mentioned carrier gas of the present invention does not include an inert gas such as nitrogen argon, xenon, helium steam, etc. However, it has been found that the above-mentioned a hydrocarbon gas of a small carbon number, of the present invention shortens treatment time with lesser amount of the gas used compared with the inert gas described in the official gazette of laid open Japanese patent application No. 86,717 of 1978. The reason for this difference is not exactly known (but it is believed that the difference of affinity to raw material pitch may be the cause).

The analysis of mesophase content was measured by quinoline insoluble matter (Q.I.) and quinoline soluble matter (Q.S.) was measured by quinoline at 80° C.

Following examples are set forth for the purposes of illustration for those skilled in the art but not for the purpose of limiting the invention in any manner.

EXAMPLE 1

A residuum carbonaceous material having a B.P. of 380° C.~384° C. or high than this range which is formed as a by-product in catalytic cracking process (F.C.C.) of vacuum gas oil, was subjected to heat treatment at 400° C. for 2 hours under a stream of hydrocarbon gas of small number of carbon atom to produce a precusor pitch and further this precusor pitch was subjected to the following heat treatment condition.

The yield of the precusor pitch was 54%. Resultant precursor pitch was treated under the following heat treatment condition.

Further as a stream of a hydrocarbon gas of small number of carbon atom to be used in the heat treatment for producing a precursor and subsequent heat treatment of the precursor, the dry gas formed as by-product in the heat-treatment reaction, was employed by recyclation.

The result of heat treatment of a precursor under atmospheric pressure

| Experiment Number | | 1 | 2 |
|---|---|---|---|
| Weight of precursor (gr) | | 1,500 | 1,500 |
| Heating condition | *Carrier gas | 4 | 4 |
| | Temperature (°C.) | 400 | 410 |
| | Time (hr) | 6 | 3 |
| Pitch | Formed amount (gr) | 1,313 | 1,305 |
| | Yield (%) | 87.5 | 87.0 |
| Distilled oil | Formed amount (gr.) | 116 | 120 |

-continued

The result of heat treatment of a precursor under atmospheric pressure

| Experiment Number | 1 | 2 |
|---|---|---|
| Yield (%) | 7.7 | 8.0 |
| Gas yield | 4.8 | 5.0 |
| Mesophase content % | 45.2 | 58.0 |

*Carrier gas = by-product dry gas (l)/precursor weight (kg) × minute. stirrer r.p.m.

EXAMPLE 2

Residuum carbonaceous material having a B.P. of more than 200° C. which was formed as a by-product in the thermal cracking of naphtha was treated under the following condition. Further, methane gas was utilized as a non-oxidative gas stream.

Results of heat treatment under atmospheric pressure

| Experiment number | | 3 | 4 |
|---|---|---|---|
| Amount of ethylene bottom (gr) | | 300 | 300 |
| Heating condition | *methane gas | 6 | 6 |
| | Temperature (°C.) | 400 | 410 |
| | Time (hr) | 5 | 5 |
| Yield of pitch (%) | | 22 | 19 |
| Flow test of pitch | Softening point (°C.) | 166 | 190 |
| | P & B corresponding softening temperature (°C.) | 218 | 256 |
| Content of mesophase | | 53.8 | 74.0 |

*methane gas = methane gas (l)/raw material (kg) × minutes

What is claimed is:

1. A method for producing a mesophase-containing pitch from petroleum pitch or coal tar pitch which comprises driving off from said pitch, volatile distillate fractions which are present orignally in the raw material pitch or formed as by-product during heat treatment time, by using as a non-oxidative carrier gas, a lower boiling point naphtha fraction or a dry gas formed during said heat treatment or a mixture of these gases at a temperature of 360° C. to 450° C. with stirring.

2. A method for producing a mesophase-containing pitch according to claim 1 in which said gas is said dry gas formed as by-product in said heat treatment reaction of the pitch.

3. A method for producing a mesophase-containing pitch from a raw material pitch selected from the group consisting of petroleum pitch and coal tar pitch, which comprises driving off volatile distillate fractions from said raw material pitch by using a non-oxidative carrier gas selected from the group consisting of methane, ethane, propane, butane and a mixture thereof at a temperature of 360° C. to 450° C. with stirring.

4. A method for producing a mesophase-containing pitch according to claim 3, wherein said carrier gas is selected from the group consisting of ethane, propane, butane and a mixture thereof.

* * * * *